US006889390B1

(12) United States Patent
Morgan et al.

(10) Patent No.: US 6,889,390 B1
(45) Date of Patent: May 10, 2005

(54) FACE MASK RETAINING SYSTEM

(75) Inventors: William B. Morgan, Santa Barbara, CA (US); Connie L. Morgan, Santa Barbara, CA (US); Trent M. Schultz, Goleta, CA (US)

(73) Assignee: Kirby Morgan Dive Systems, Inc., Santa Barbara, CA (US)

( * ) Notice: Subject to any disclaimer, the term of this patent is extended or adjusted under 35 U.S.C. 154(b) by 0 days.

(21) Appl. No.: 10/723,651

(22) Filed: Nov. 25, 2003

(51) Int. Cl.[7] ..... A42B 1/04

(52) U.S. Cl. ..... 2/202; 2/424; 441/124; 128/201.27; 128/201.29; 128/207.11

(58) Field of Search ..... 2/2.15, 2.14, 2.11, 2/424, 173, 205, 202; 441/124, 105; 128/201.27, 206.24, 201.23, 207.11, 207.17, 201.29

(56) References Cited

U.S. PATENT DOCUMENTS 2,910,063 A * 10/1959 Monroe et al. ..... 128/205.24
2,935,985 A * 5/1960 Andrews et al. ..... 128/201.23
3,624,663 A * 11/1971 Jones ..... 2/424
3,672,365 A * 6/1972 Morgan ..... 128/201.27
3,680,556 A * 8/1972 Morgan ..... 128/201.15
3,892,234 A * 7/1975 Jones ..... 128/201.27
4,475,248 A * 10/1984 L'Abbe et al. ..... 2/2.5
5,924,420 A * 7/1999 Reischel et al. ..... 128/206.21
6,155,253 A * 12/2000 Gamberini ..... 128/201.18
2002/0046752 A1 * 4/2002 Tischer et al. ..... 128/201.29
2002/0092522 A1 * 7/2002 Fabin ..... 128/201.23

FOREIGN PATENT DOCUMENTS

GB 2080120 A * 2/1982 ..... A62B/18/02

* cited by examiner

*Primary Examiner*—Rodney M. Lindsey
(74) *Attorney, Agent, or Firm*—Cislo & Thomas LLP

(57) ABSTRACT

A retaining system for the hood, face seal, and mounting band(s) of facemasks that have a hood and/or a face seal that are sealed and securely mounted to the mask using a band type of clamping method, is provided. The retaining system may include a redundant system that may not allow the mask to be separated from the hood, face seal, and the mounting band(s).

17 Claims, 3 Drawing Sheets

FACE MASK RETAINING SYSTEM

BACKGROUND

There may be many different types of personnel protective masks (diving, firefighting, mining, confined space, etc.) that may use a mounting band type clamp to securely mount and seal the hood and/or face seal components to the mask.

The mount band(s) on these masks may be a hose clamp-type of design. They may be a long strap that may be configured to couple the ends together, which is utilized for adjusting or tightening a hood to the mask. The tightening action of the mounting band(s) may be what securely clamps and seals the hood, and/or face seals the mask. This may allow the hood and/or face seals to be regularly maintained or changed.

The masks may have a groove or mounting surface around the back edge of the mask where the hood and/or face seal fit across and/or into for mounting to the mask. The mounting band(s) then may fit over the hood and/or face seal into this groove in the mask. This groove may help to hold everything in place when it has all been installed and tightened. There may be, however, nothing that physically or mechanically connects and secures the mounting band(s) to the mask, it may be merely the clamping force of the mounting band holding the hood and/or face seal and mounting band(s) in the groove and sealing them to the mask.

Some of the mounting band(s) may have head harness mount studs or buckles attached to them. A problem may arise when masks using mounting band(s) are not correctly maintained and properly adjusted, as they may become loose. If the band(s) become loose there may be the potential that the mask may separate from any combination of the hood, face seal, or mounting band(s), or the mask from all of them at once.

The hoods and/or face seals currently being produced for personnel protective masks may use the mounting band(s) design to mount the hood and/or face seal, may have a flat mounting flap-type of area for the attachment/sealing of the hood and/or face seal to the mask. This flap area, when installed, may be clamped between the mounting band(s) and the mask securing and sealing the hood and/or face seal to the mask.

There may be several different types of hoods and/or face seals. Some may be just a hood or just a face seal. Some may have the face seal glued to the inside of the hood. Some may stack the face seal, then the hood under the mounting band(s) on the mask.

Some hoods and/or face seals may have a mating groove molded or created into them for the mounting band(s) to mate or fit into. Some of them may have a bump or protrusion at the end of the mounting flap that may help prevent the mounting flap from being extracted or pulled out from between the mounting band(s) and mask. Both the mating groove and bump or protrusion at the end of the flap may fail if the mounting band(s) are not properly maintained, are out of adjustment, or if there is a catastrophic failure (broken bolt, stripped nut, etc.).

What is needed is a retaining system that may provide a redundant, retrofittable, and safer system for retaining masks, and the like, a greater level of safety, and may be retrofittable to existing systems.

SUMMARY

Exemplary embodiments may include a mask retaining system, including a mask, a hood configured to cover a head of a user, a mount band integral with the hood, configured to couple to the mask, and to form a seal between the hood and the mask, and a harness configured to couple to the mask and the mount band.

DETAILED DESCRIPTION

Figure 1:
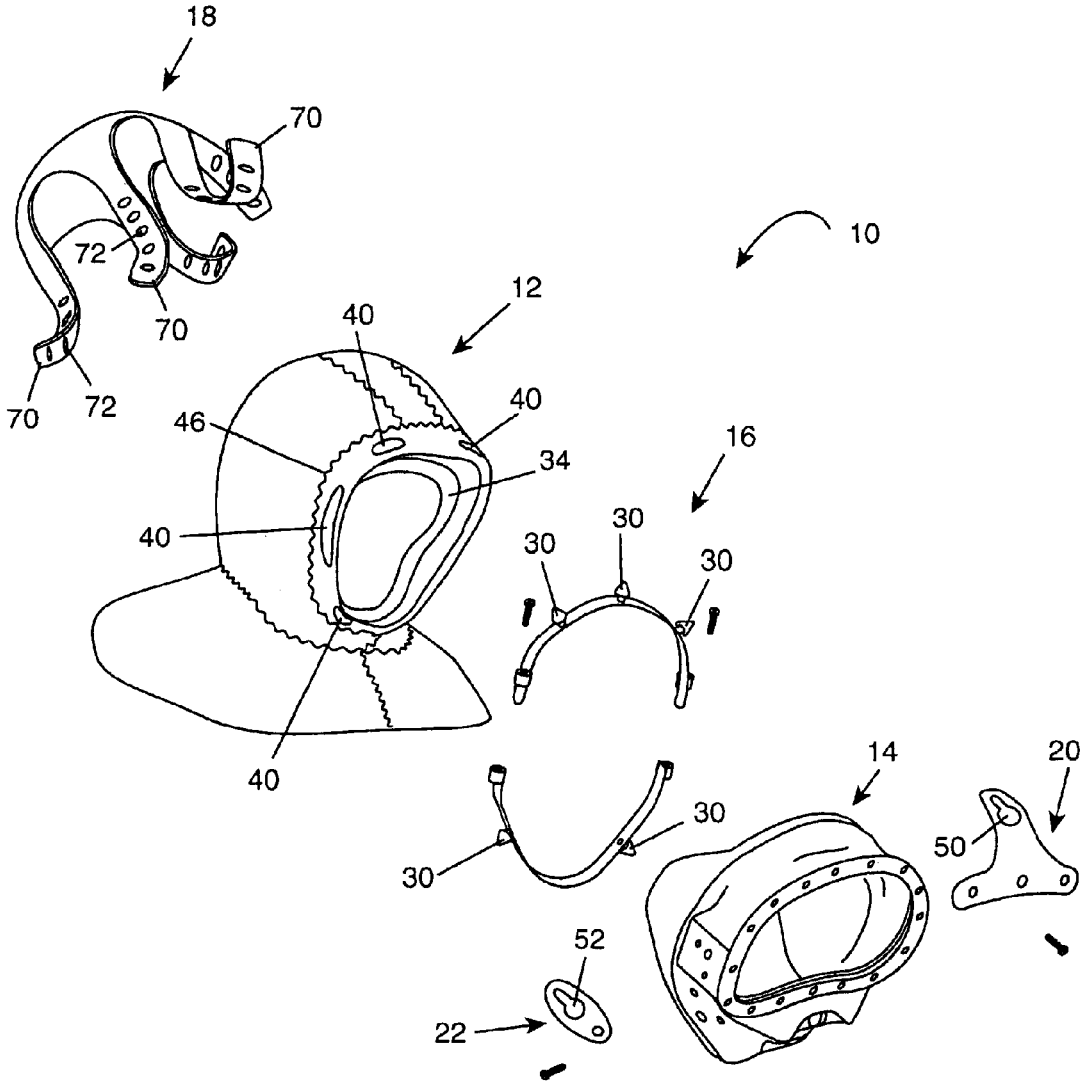
FIG. 1 is a perspective view of a retaining system according to an exemplary embodiment.

The detailed description set forth below in connection with the appended drawings is intended as a description of exemplary embodiments and is not intended to represent the only forms in which the embodiments may be constructed and/or utilized. The description also sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Exemplary embodiments may incorporate a hood and/or face seal that may be produced with the mounting flap area of the hood and/or face seal being able to securely couple to a mounting band. The front edge of the mounting flap area of the hood and/or face seal may be extended, then folded back and attached (sewn, glued, molded, etc.) to itself creating a strong tube-like hollow area large enough to be configured to receive the mounting band(s). The tube-like hollow space may have orifices or apertures, formed within it, which may allow the mounting band to be slipped into, or fed therethrough, and into the hollow area, thereby coupling the mounting band(s) to the hood, within the hollow area. Screw(s) or other coupling devices and configurations may then be installed into the mounting band(s). With this configuration, there may be no possible way for the hood and/or face seal to separate from the mounting band(s). There may also be additional holes adjacent to the hollow area, which may allow the head harness mounts, coupling structures, or buckles that may be attached to the mounting band(s), to be accessible to a user.

Once the hood and/or face seal that couples to the mounting bands are properly fitted and installed onto the mask, the mounting band(s) may be mechanically coupled to the mask. This may be achieved with several different methods, including, but not limited to, connecting plate(s), wire or cable(s), or drilling through the mounting band itself and using screws, bolts and nuts. The connecting plate(s) design may be preferred because of ease of manufacturing, less maintenance, and better sealing arrangement to the mask, as well as easier retrofitting of existing systems.

One exemplary embodiment of the connecting plates may allow for retrofittability to the existing mount bands and masks. This connecting plate may have an orifice or hole with an elongated slot at one end. The hole may be slipped over the head of the head harness mount stud, or coupling structure, on the mounting band(s). The connecting plate may then be moved, such that the slot is caught between the head of the head harness mount stud and the mounting band itself. Using a separate smaller hole in the connecting plate, the connecting plate may then be securely coupled to the mask by drilling a hole in the mask and using screws or a bolt and nut to mechanically fasten the connecting plate to the mask, or other coupling configuration, as desired.

An exemplary embodiment of the connecting plate may allow for retrofitability to the existing mount band(s), and may provide a head harness mounting stud or head harness adjustment buckle that may be attached, or an integral part of the connecting plate. This may allow the force of the pull created by the head harness to be distributed to the connecting plate rather than the mounting band(s).

A diving mask retaining system according to an exemplary embodiment is shown in FIG. 1, generally at 10. FIG. 1 is an exploded view of a system according to an exemplary embodiment. System 10 may include a hood 12, a mask 14, and a band 16 configured to couple the hood 12 to mask 14. System 10 may further include a harness 18 configured to couple to band 16, such that an airtight and/or watertight seal is created and maintained between mask 14 and hood 12, as well as between hood 12 and/or mask 14, and a user.

System 10 may also include a top bracket 20 that may be configured to couple to mask 14 and to band 16, as well as hood 12. System 10 may further include one or more side brackets 22 configured to couple to mask 14, band 16, and hood 12. With this configuration, mask 14 and hood 12 may be securely coupled together such that when a user is using this system in water or other areas, the portions may be coupled together safely such that air or water may not enter.

Furthermore, band 16 may be integral with hood 12 in that it may be coupled to hood 12 such that if band 16 loosens, it will not allow band 16 and hood 12 to separate. It may also not allow hood 12 to separate from mask 14. Hood 12 may be configured in a loop-like configuration to receive band 16, and may include orifices 40 to allow coupling structure 30 of band 16 to extend therethrough. Hood 12 may also include a seam 46 which may secure the hood to itself. This configuration may secure band 16 to hood 12. It will be appreciated that other hood and band configurations, as well as different coupling configurations may be utilized, as desired.

Band 16 may include coupling structures 30 that may be configured to couple to harness 18 and brackets 20 and 22 such that an airtight and/or watertight seal may be maintained between hood 12 and mask 14.

Hood 12 may be a diving hood such that it may be configured to enclose the head of a user. Furthermore, hood 12 may be made from neoprene, or other material that may be used for diving, firefighting, or other activity. Hood 12 may further include face seal 34 that may be configured to contact the face of a user such that when the system is utilized, an airtight and/or watertight seal will be maintained between seal 34 and the face of a user such that an alternative breathing apparatus may be utilized for breathing in water, near a fire, or other situation where an alternative breathing apparatus is desired. It will be appreciated that other configurations may be utilized, as desired.

Hood 12 may also be configured with orifices 40 that will allow coupling structures 30 to extend therethrough. Furthermore, hood 12 may be configured to be coupled to band 16 such that band 16 and hood 12 are integral with each other. This coupling may be via a sewn loop within hood 12, such that band 16 may reside in the area created by the loop, and band 16 may be selectively removable therefrom. In this manner, a band 16 may be removed from a hood such that when a new one is needed or desired, it may be replaced.

Band 16 is typically a hose clamp-type configuration that may be coupled and tightened such that an airtight and/or watertight seal may be created between hood 12 and mask 14. It will be appreciated that other coupling configurations and designs may be utilized for band 16, as desired. Band 16 is typically made of metal, but also may be made of other materials such as plastic compounds, rubber compounds, metal compounds, and combinations thereof.

Mask 14 may be a mask utilized for diving, for firefighting, or other activity where an airtight and/or watertight seal is necessary, or when an alternative breathing apparatus is required, desired, or needed, or for other activities.

Top bracket 20 may couple to mask 14 via a screw, bolt, rivet, adhesive, or may be integrally formed with mask 14, or other coupling configuration, as desired. Top bracket 20 may include an orifice 50 that may be configured to allow coupling structure 30 to extend therethrough to secure band 16 to mask 14 and top bracket 20. Top bracket 20 may be made from metal, plastic compounds, rubber compounds, and combinations thereof, or other materials, as desired.

Side bracket 22 is configured to couple to mask 14 and to band 16 via coupling structures 30. Side bracket 22 typically includes an orifice 52 to allow coupling structure 30 to extend therethrough and to slide into a second position such that side bracket 22 and mask 14 are securely coupled to band 16. Furthermore, since band 16 may be integrally coupled with hood 12, hood 12 may be coupled to mask 14 in an airtight and/or watertight manner. Side bracket 22 may be coupled to mask 14 via a screw, bolt, rivet, adhesive, or other coupling configuration, as desired. Mask 14 is typically a mask used in firefighting, diving, or other activity.

Harness 18 is configured to couple to coupling structures 30 such that an airtight and/or watertight seal may be maintained between face seal 34 and the user's face, and also an airtight and/or watertight seal between mask 14 and hood 12. Harness 18 may include flanges 70 and orifices 72. Flanges 70 may be configured to extend around a head of a user, however, other configurations may be utilized, as desired. Orifices 72 may be configured to couple to coupling structures 30. More than one orifice may be couple to a single coupling structure 30, which may be more safe such that harness 18 may be less likely to uncouple from coupling structures 30. Harness 18 is typically made from a rubber and/or plastic compound; however, other materials may be utilized, as desired.

Figure 2:
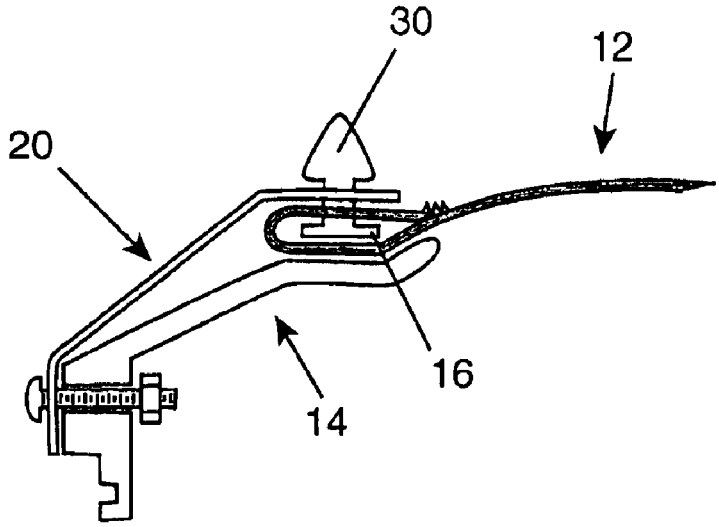
FIG. 2 is a close up view of a portion of a system according to an exemplary embodiment.

FIG. 2 shows a close-up view of an exemplary embodiment of the system. The system may include hood 12, mask 14, and band 16. The system may also include top bracket 20, and band 16 may include coupling structure 30. In this embodiment, hood 12 is configured to receive band 16 such that coupling structure 30 will extend through an orifice in hood 12 such that top bracket 20 may couple to coupling structure 30. Top bracket 20 may also couple to mask 14 via a nut-and-bolt configuration, as shown, however, other coupling configurations may be utilized, as desired, including, but not limited to screw, rivet, adhesive, and the like. In this manner when top bracket 20 is coupled to mask 14 and to band 16, and consequently hood 12 via coupling structure 30, an airtight and/or watertight seal may be created between hood 12 and mask 14 when band 16 is tightened sufficiently to create a compression coupling between hood 12 and mask 14.

Figure 3:
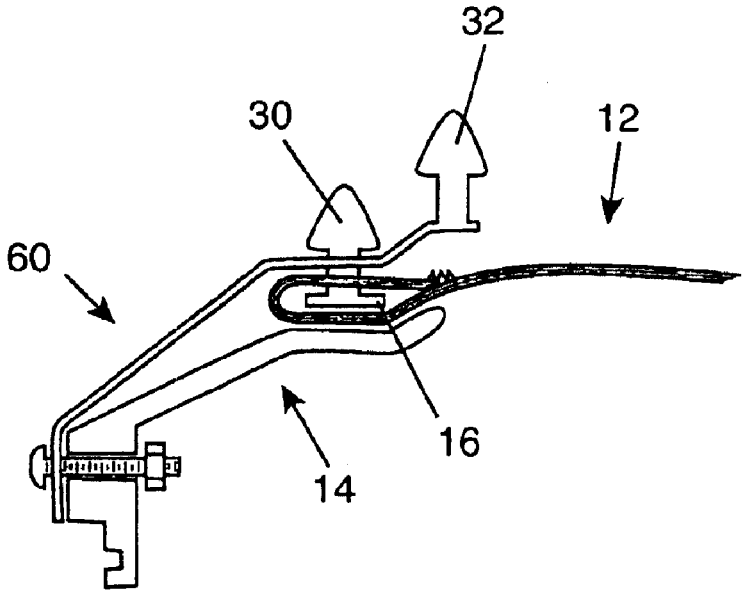
FIG. 3 is a close up view of a portion of a system according to an exemplary embodiment.

FIG. 3 shows an exemplary embodiment again including hood 12, mask 14, and band 16, as well as coupling structure 30. This system may also include a top bracket 60 that is configured to couple to mask 14, as well as coupling structure 32. Furthermore, top bracket 60 may include a coupling structure 32 that is configured to couple to the flanges 70 and orifices 72 of harness 18 to securely couple mask 14 to hood 12 and to create an airtight and/or watertight seal between hood 12 and mask 14, as well as between the user and the face seal. Coupling structure 30 may also be configured to couple to harness 18 to securely couple hood 12 to mask 14 and to securely couple the system to a user.

Figure 4A:
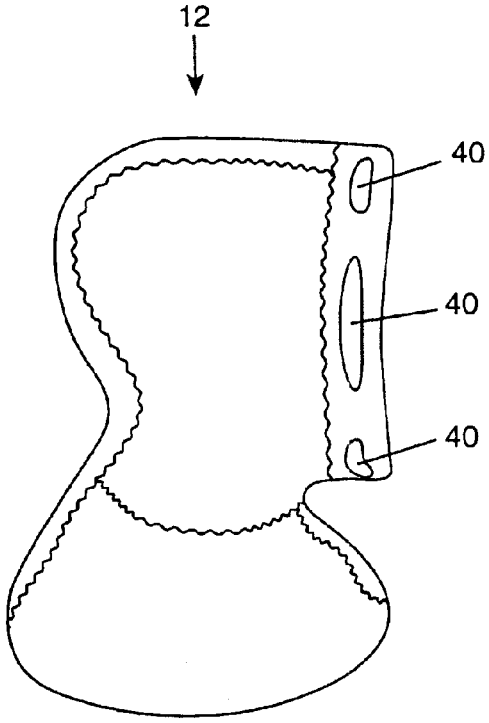
FIG. 4*a* is a perspective view of a portion of a system according to an exemplary embodiment.

FIG. 4*a* shows a hood according to an exemplary embodiment, generally at 12. Hood 12 may include orifices 40 that are configured to allow a band 16 to be inserted into a space created when hood 12 is folded over and secured to itself. Furthermore, orifices 40 are configured to allow coupling structures to extend therethrough to allow coupling to the mask and the harness of a system. Hood 12 may also include a seam 46, which may be configured to allow an area for securely receiving a band of the system. Seam 46 may be sewn, however, an adhesive may also be used as well as other coupling configurations, as desired. Furthermore, it will be appreciated that although hood 12 is shown folded over to create the area to receive a band, other configurations may be utilized, such as other devices coupled to hood 12, among others, as desired.

Figure 4B:
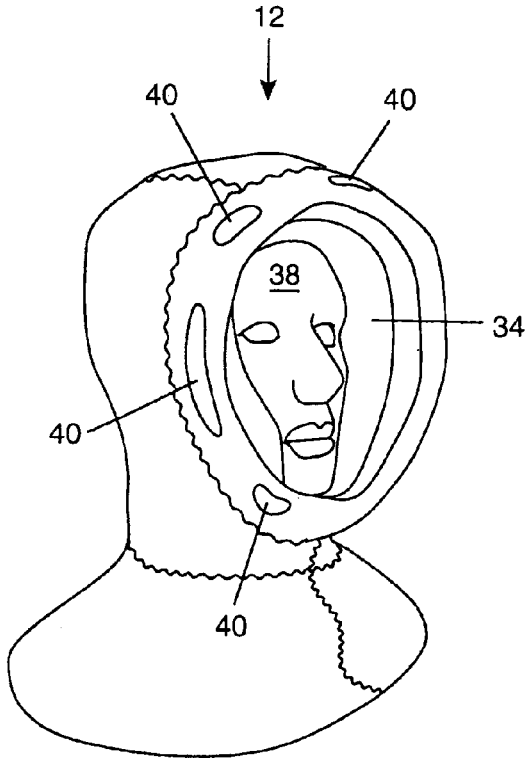
FIG. 4*b* is a perspective view of a portion of a system according to an exemplary embodiment.

FIG. 4*b* shows an exemplary embodiment including a user 38. The face of user 38 is typically adjacent to seal 34 such that an airtight and/or watertight seal may 20 be created between seal 34 and the user 38. Hood 12 may include a face seal 34, however it will be appreciated that face seal 34 may be coupled to other parts of the system including the mask and others, as desired. Again, hood 12 includes orifices 40 to allow the harness to be received and for coupling structures to extend therethrough to allow coupling of the mask 14 to band 16, as well as harness 18 and hood 12.

With these configurations, the force of the harness may be distributed to parts of the system other than the mount band. This may increase the safety of the system, and allow the band to last longer before being replaced.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof.

What is claimed is:

1. A face mask retaining system, comprising:

a face mask;

a hood configured as a head cover;

a mounting band integral with said hood and configured to couple to said face mask and form a seal between said hood and said face mask;

a head harness configured to hold said face mask against the face of a user; and at least one bracket configured to couple said face mask to said integral mounting band, said integral mounting band comprising a plurality of spaced apart coupling structures configured to couple to said head harness and to said at least one bracket, said at least one bracket being configured to couple to said coupling structures of said integral mounting band, said at least one bracket comprising a coupling structure configured to couple to said head harness, said head harness comprising a plurality of flanges configured to extend around said hood, and a plurality of orifices within each of said flanges configured to couple to said coupling structures of said integral mounting band and said coupling structure of said at least one bracket.

2. A face mask retaining system, comprising:

a face mask;

a hood configured as a head cover;

a mounting band integral with said hood and configured to couple to said face mask and form a seal between said hood and said face mask;

a head harness configured to hold said face mask against the face of a user; and at least one bracket configured to couple said face mask to said integral mounting band;

said integral mounting band comprising a plurality of spaced apart coupling structures configured to couple to said head harness and to said at least one bracket;

said at least one bracket being configured to couple to said coupling structures of said integral mounting band;

said at least one bracket comprising a coupling structure configured to couple to said head harness;

said head harness comprising a plurality of flanges configured to extend around said hood, and a plurality of orifices within each of said flanges configured to couple to said coupling structures of said integral mounting band and said coupling structure of said at least one bracket, wherein more than one of said plurality of orifices is adapted to couple to each of said coupling structures.

3. A face mask retaining system, comprising:

a face mask;

a hood configured as a head cover;

a mounting band integral with said hood and configured to couple to said face mask and form a seal between said hood and said face mask;

a head harness configured to couple to said face mask and to said integral mounting band; and at least one bracket configured to couple said face mask to said integral mounting band, said at least one bracket comprising a coupling structure configured to couple to said head harness;

said integral mounting band comprising a plurality of spaced apart coupling structures configured to couple to said head harness and to said at least one bracket;

said head harness comprising a plurality of flanges configured to extend around said hood, and a plurality of orifices within each of said plurality of flanges configured to couple to said coupling structure of said integral mounting band and said coupling structure of said at least one bracket.

4. A system for retaining a mask over the face of a user, comprising:

at least one mounting band;

a hood with a substantially tubular end adapted to receive and hold said at least one mounting;

a harness adapted to fit over said hood, said harness configured for coupling to said at least one mounting band; and at least one bracket adapted to engage said harness and securely couple the mask to said at least one mounting band when said at least one mounting band is being held by said hood.

5. The system of claim 4, wherein said at least one mounting band is equipped with a plurality of mounting studs.

6. The system of claim 5, wherein said at least one bracket is adapted to engage at least one of said hood mounting studs.

7. The system of claim 5, wherein said substantially tubular end of said hood is provided with a plurality of orifices.

8. The system of claim 7, wherein said mounting studs are adapted to extend through said orifices.

9. The system of claim 7, wherein at least one of said orifices is adapted to receive said at least one mounting band.

10. A system for retaining a mask over the face of a user, comprising:

at least one mounting band;

a hood with a substantially tubular end adapted to receive and hold said at least one mounting band;

a harness adapted to fit over said hood, said harness including a plurality of flanges adapted for coupling to said at least one mounting band; and at least one bracket adapted to engage at least one of said flanges and securely couple the mask to said at least one mounting band when said at least one mounting band is being held by said hood.

11. The system of claim 10, wherein said at least one bracket is equipped with at least one harness mounting stud.

12. The system of claim 11, wherein at least one of said flanges is equipped with a plurality of orifices.

13. The system of claim 11, wherein said at least one harness mounting stud is adapted to engage at least one of said orifices.

14. A system for retaining a mask over the face of a user, comprising:

a first strap;

a second strap adapted to be clamped to said first strap, each of said first and second straps being equipped with a plurality of mounting studs;

a hood with a substantially tubular end adapted to receive and hold said first and second straps, said substantially tubular end being provided with a plurality of orifices, said mounting studs adapted to extend through said orifices;

a harness adapted to fit over said hood, said harness including at least one flange adapted to be engaged by at least one of said mounting studs; and at least one bracket configured to engage said at least one flange and securely couple the mask to at least one of said mounting studs when said clamped first and second straps are being held by said substantially tubular end of said hood.

15. The system of claim 14, wherein said at least one flange is equipped with a plurality of orifices.

16. The system of claim 15, wherein said at least one bracket is equipped with at least one harness mounting stud.

17. The system of claim 16, wherein said at least one harness mounting stud is adapted to engage at least one of said flange orifices.

* * * * *